US008011170B2

(12) United States Patent
Smith et al.

(10) Patent No.: US 8,011,170 B2
(45) Date of Patent: Sep. 6, 2011

(54) CLOTHING PACKING APPARATUS AND METHOD OF USING

(76) Inventors: Paul Smith, Surrey (GB); Wai Kwon Tang, Hong Kong (CN)

( * ) Notice: Subject to any disclaimer, the term of this patent is extended or adjusted under 35 U.S.C. 154(b) by 0 days.

(21) Appl. No.: 12/440,356

(22) PCT Filed: Sep. 7, 2007

(86) PCT No.: PCT/GB2007/003385

§ 371 (c)(1),
(2), (4) Date: Mar. 6, 2009

(87) PCT Pub. No.: WO2008/029157

PCT Pub. Date: Mar. 13, 2008

(65) Prior Publication Data

US 2009/0277138 A1 Nov. 12, 2009

(30) Foreign Application Priority Data

Sep. 8, 2006 (GB) ..... 0617783.6

(51) Int. Cl.
*B65B 63/04* (2006.01)
*B65D 85/18* (2006.01)

(52) U.S. Cl. ..... 53/429; 53/117; 206/297; 223/37; 229/87.17

(58) Field of Classification Search ..... 53/429, 53/116, 117; 206/297; 223/37, 38, 71; 229/87.15, 229/87.17

See application file for complete search history.

(56) References Cited

U.S. PATENT DOCUMENTS

| | | | | | |
|---|---|---|---|---|---|
| 588,587 | A | * | 8/1897 | Locke | 229/87.15 |
| 1,657,551 | A | * | 1/1928 | Schremp | 223/37 |
| 1,780,137 | A | * | 10/1930 | Lee | 229/87.15 |
| 1,838,262 | A | * | 12/1931 | Kabins | 223/71 |
| 2,204,419 | A | * | 6/1940 | Lighter | 229/87.17 |
| 2,236,577 | A | * | 4/1941 | Morse | 229/87.17 |
| 2,487,761 | A | | 11/1949 | McFall et al. | |
| 3,138,245 | A | | 6/1964 | Wachtel | |
| 3,149,718 | A | | 9/1964 | Wolf | |
| 3,444,994 | A | * | 5/1969 | Kaepernik et al. | 206/63.3 |
| 3,688,948 | A | | 9/1972 | Roda | |

(Continued)

FOREIGN PATENT DOCUMENTS

DE 29702371 A1 3/1997

(Continued)

OTHER PUBLICATIONS

International Search Report, for PCT/GB2007/003385, mailed Feb. 19, 2008, 3 pages.

*Primary Examiner* — Stephen F Gerrity
(74) *Attorney, Agent, or Firm* — William J. Sapone; Coleman Sudol Sapone P.C.

(57) ABSTRACT

A clothing packing apparatus for folding a clothing article, such as a suit, comprising a spacing material to separate parts of the folded clothing article comprises a parts that partial overlay a fold line in the aligned sleeves and the body of an article of clothing; a slit for folding the sleeves independently; gripping surfaces to engage the clothing article; rounded/tapered edges to eliminate pressure compressions; pre-formed bands to improve folding performance; and a casing for storage and transit. The spacing material is preferably formed of foam capable of forming a continuous U-shaped curve along the fold lines and an anti-collapsible structure when folded with the clothing article.

13 Claims, 12 Drawing Sheets

U.S. PATENT DOCUMENTS 4,116,335 A 9/1978 Leopold
4,120,395 A * 10/1978 Mandel et al. ..... 206/63.3
4,240,553 A * 12/1980 Leopold ..... 206/297
4,253,563 A * 3/1981 Komarnycky ..... 206/63.3
4,483,437 A * 11/1984 Cerwin et al. ..... 206/63.3
4,555,016 A * 11/1985 Aday et al. ..... 206/63.3
4,569,441 A 2/1986 Inghirami
4,884,681 A * 12/1989 Roshdy et al. ..... 206/63.3
5,011,052 A * 4/1991 Craig ..... 223/37
5,154,329 A 10/1992 Dorfmueller
5,341,622 A * 8/1994 Odermatt et al. ..... 53/429
5,425,445 A * 6/1995 Brown et al. ..... 206/63.3
5,439,107 A * 8/1995 Penet et al. ..... 206/292
5,887,711 A 3/1999 McAuliffe
5,947,366 A 9/1999 Feldmann et al.
5,961,033 A 10/1999 Wang
6,279,791 B1 * 8/2001 Betman et al. ..... 223/37
6,360,927 B1 * 3/2002 Barker ..... 223/37
6,814,269 B1 * 11/2004 Fernandez ..... 223/37
7,565,787 B2 * 7/2009 Licari ..... 53/429

FOREIGN PATENT DOCUMENTS

GB 1510905 A1 5/1978

* cited by examiner

CLOTHING PACKING APPARATUS AND METHOD OF USING

This application is a U.S. national stage of PCT International Application no. PCT/GB2007/003385, filed Sep. 7, 2007.

FIELD OF THE INVENTION

The present invention relates to a clothing packing apparatus. More specifically the present invention relates to a lightweight clothing packing apparatus for folding a clothing article that has a body and sleeves, such as a suit, to a compact size with a specific method of packing that can, remove wrinkles before the clothing article is folded;

prevent wrinkles and creases from forming in the clothing article when folding the clothing article; and prevent wrinkles and creases from forming in the folded clothing article when it is put in storage or transit.

BACKGROUND OF THE INVENTION

Clothing carriers, such as suit-carriers and garment bags, for packing clothing articles are common but they are typically bulky, heavy and do not prevent wrinkles and creases from forming in the clothing articles, when packing the clothing articles, or when the clothing articles are packed, in storage, or in transit.

Clothing carriers are normally designed to receive clothing articles hung on clothing hangers. The clothing carriers are generally made wider and longer than the clothing articles they carry to receive clothing articles of different sizes. Clothing articles and clothing hangers are commonly inserted together into the clothing carrier, with the clothing article hung on the clothing hanger, and are hung from the upper-end of the clothing carrier when the clothing carrier is hung in an open condition. The inserted and hung clothing articles are then secured by fasteners, such as flaps, across the sleeves and body of the clothing articles, before the clothing articles are subsequently folded across the sleeves and the body when the clothing carrier is folded to the closed condition to reduce its overall size to ease handling for storage and/or transit.

Clothing articles packed in clothing carriers are typically wrinkled before the clothing article is folded with the clothing carrier. Accordingly, creases are formed separately at four different times: when the fasteners are tied across the wrinkles in the clothing articles to secure the clothing article to the clothing carrier; when the wrinkled clothing articles are folded with the clothing carrier from the open condition to the folded state; when the wrinkled clothing articles are compressed as the clothing carrier is locked to the folded state; and when the wrinkled clothing articles are compressed in storage and/or transit.

A particular need exists for a clothing packing apparatus for folding a clothing article, such as a suit, that can:

remove wrinkles in the clothing article before the clothing article is folded;

prevent wrinkles and creases from forming in the clothing article when the clothing article is folded; and prevent wrinkles and creases from forming in the clothing article when the clothing articles is compressed in storage and/or transit.

Presently, clothing articles, such as suits, are typically stored and carried in conventional clothing carriers, such as suit-carriers or garment bags. Besides their large dimension and/or heavy weight, clothing, articles are packed into conventional clothing carrier before they are folded, a major step in the packing process that causes a significant amount of wrinkles to form in the clothing article that lead to the formation of creases in folded clothing articles when the folded clothing articles are compressed at different times when they are stored in their folded state.

Prior art to remove wrinkles and creases in packed clothing article is known. U.S. Pat. No. 5,887,711 relates to a garment carrier that require a pleated garment to be placed on a simple, sized, rectangular flexible sheet material before it is furled together with the flexible sheet material to wrap the clothing article in the form of a roll, to prevent wrinkles and creases from forming in the clothing article.

However, furling a clothing article that has a body and sleeves, such as a suit, together with a simple, sized, rectangular flexible sheet material is difficult and ineffective. The thick padded shoulder areas and three-dimensional structured sleeves of the clothing article are difficult to roll, and the roll produced is bulky and heavy from the large flexible sheet material needed for the exercise.

Moreover, the clothing article is squeezed between the flexible sheet material when the clothing article is furled, causing the clothing article to wrinkle, and subsequently crease the clothing article when the clothing article is eventually sandwiched by the flexible sheet material.

SUMMARY OF THE INVENTION

Therefore, it is an object of the present invention to provide a clothing packing apparatus suitable for folding a clothing article of any size that has a body and sleeves, such as a suit.

It is another object of the present invention to provide a method of packing a clothing article, which has a body and sleeves, capable of, removing wrinkles in the clothing article before the clothing article is folded;

preventing wrinkles and creases from forming in the clothing article when the clothing article is folded; and preventing wrinkles and creases from forming in the clothing article in the folded state when clothing article is compressed in storage or transit.

It is a further object of the present invention to provide a clothing packing apparatus that is lightweight and can fold the clothing article easily and quickly to a versatile compact size, which can be stored in different types of comfortable and easy to carry outer casing.

According to the present invention, there is provided a clothing packing apparatus as claimed in the accompanying claims.

In an embodiment, the present invention provides a clothing packing apparatus for folding an article of clothing of any size, such as a suit, which has a body and two aligned sleeves when the clothing article is laid in a stretched-out open condition to remove the wrinkles in the clothing article before the clothing article is folded, where the body is sectioned into three parts along its length: a upper-body, a central-body, and an lower-body to enable the clothing article to fold from the stretched-out open condition to the folded state.

In an embodiment, a spacing layer of crease-resistant flexible spacer material is locatable overlaying the clothing article when the clothing article is laid in a stretched-out open condition has a first portion; and a second portion, to allow the clothing article to be folded from the stretched-out open condition to the folded state, wherein:

the first portion is for overlaying two aligned sleeves and a fold line in the aligned sleeves to enable the first portion to freely and discretely move with the aligned sleeves to freely and discretely fold the aligned sleeves around the first fold line in the flexible spacer material onto the central-third area of the second portion;

the second portion is for overlaying the body of the clothing article and two parallel fold lines in the body to allow adjacent parts of the body to freely and discretely move with the adjacent parts of the spacing layer to freely and discretely fold the adjacent parts of the body onto the central-third area of the second portion; and the second portion has three areas along its length: an upper-third area, a central-third area, and a lower-third area, locatable overlaying the upper-body, central body and lower-body along the length of the body of the clothing article respectively.

In an embodiment, the spacing layer of crease-resistant flexible spacer material is configured to form spacers to separate parts of the clothing article folded to face each other when the clothing article is folded from the stretched-out open condition to the folded state, to stop the clothing article from completely folding together to prevent creases from forming along the fold lines in the clothing article when the clothing article is compressed in storage or transit.

In an embodiment, the spacing layer of crease-resistant flexible spacer material forms a continuous curve, U-shaped in cross-section, along the fold lines, to provide a radius along the fold lines in the clothing article folded around the spacer, to stop the parts of the clothing article from folding completely together to prevent creases from forming along the fold lines in the clothing article when the clothing article folded around the spacing layer is compressed in storage and/or transit.

In an embodiment, the spacing layer of crease-resistant flexible spacer material forms a three-dimensional anti-collapsible structure when the clothing article is folded around the spacing layer, to prevent the weight of the clothing article and/or applied loadings from buckling the flexible spacer material and causing the clothing article folded around the spacing layer to wrinkle when the folded clothing article is stored in an upright position in storage and/or transit, and in turn maintain the clothing article folded around the spacing layer in the folded state to prevent creases from forming in the clothing article when the clothing article folded around the spacing layer is subsequently compressed in storage and/or transit.

In an embodiment, the spacing layer of crease-resistant flexible spacer material forms a three-dimensional anti-collapsible structure when the clothing article is folded around the spacing layer, to prevent the weight of the clothing article and/or applied loadings from buckling the flexible spacer material and causing the clothing article folded around the spacing layer to wrinkle when the folded clothing article is stored in an upright position in storage and/or transit, and in turn maintain the clothing article folded around the spacing layer in the folded state to prevent creases from forming in the clothing article when the clothing article folded around the spacing layer is subsequently compressed in storage and/or transit.

In an embodiment, the spacing layer of crease-resistant flexible spacer material has a fold line in the first portion that lies at least partially within the width of the central-third area, and between the lower-third area and the upper-third area, to enable the aligned sleeves to freely and discretely move and fold at an angle onto the central-third area in a stretched-out condition, to prevent wrinkles from forming in the aligned sleeves when the clothing article is folded from the stretched-out open condition to the folded state and creases from forming in the aligned sleeves when the clothing article is compressed in storage and/or transit.

In an embodiment, the spacing layer of crease-resistant flexible spacer material has a single first portion for overlaying two aligned sleeves, to keep the bulk of the spacer material to a minimum to enable the clothing article to fold to a compact dimension, as well as minimizing the number of steps of folding the clothing article from the stretched-out open condition to the folded state to simplify the folding process.

In an embodiment, the spacing layer of crease-resistant flexible spacer material has a slit, configured parallel or at an angle to the longitudinal axis of the second portion extending from the boundary separating the lower-third area and central-third area, that partially separate the first portion and second portion to enable the aligned sleeves and adjacent parts of the body to freely and discretely move and fold onto the central-third area of the apparatus, to prevent wrinkles from forming in the clothing article when the clothing articled is folded around the spacing layer from the stretched-out open condition to the folded state and creases forming in the clothing article when the clothing article is compressed in storage an/or transit.

In an embodiment, the spacing layer of crease-resistant flexible spacer material is formed of foam or rubber to ensure the clothing article folded around the spacing layer is lightweight and comfortable to carry.

In an embodiment, the spacer material has a thickness of at least 3 mm to provide an adequate radius in the continuous curve, U-shaped in cross-section, along the fold lines; to prevent creases from forming in the clothing article along the fold lines when the clothing article is compressed in storage and/or transit.

In an embodiment, the spacing layer of crease-resistant flexible spacer material has gripping surfaces, to engage the clothing article and the spacing layer itself, to prevent the clothing article and the spacing layer from sliding relative to one another, to prevent wrinkles and creases from forming in the clothing article when the clothing article is folded around the spacing layer from the stretched-out open condition to the folded state and when the folded clothing article is stored in an upright position in storage and/or transit, as well as to stop the clothing article and spacing layer from moving relative to one another to ease the folding process when the clothing article is folded from the stretched-out open condition to the folded state.

In an embodiment, the spacing layer of crease-resistant flexible spacer material has rounded or tapered edges, to prevent pressure compressions from forming in parts of the clothing article overlapping the edges of the spacing layer when the clothing article folded around the spacing layer is compressed in storage or transit, wherein:

the tapered edges has an angle less than 30 degree to the surface of the spacer material.

In an embodiment, the spacing layer of crease-resistant flexible spacer material has pre-formed markings centered along the fold lines in the flexible spacer material to reduce the rebound strength of the flexible spacer material, to reduce the tendency of the flexible spacer material to spring up and away from the folded condition, to allow the spacer material to fold more evenly and consistently to improve the folding performance of the spacer material, as well as to allow the flexible spacer material fold more easily to ease the folding process.

In an embodiment, the pre-formed markings has a width of least 3 cm, centered along the fold lines, to provide a visual aid to clearly and quickly locate the fold lines to simplify the folding process.

In an embodiment, the present invention has an outer casing to allow the clothing article folded around the spacing layer to be maintained and stored in the folded state, and to enable the clothing article folded around the spacing layer to be carried easily, comfortably and conveniently.

In an embodiment, the outer casing is formed of fabric, paper, plastic or metal, to meet different needs and/or modes of transportation, to maximize the versatility of the present invention.

In an embodiment of the present invention, a method of packing a clothing article that has a body and sleeves, to simply, easily and quickly fold a clothing article, in which:

a single spacing layer of crease-resistant flexible spacer material is used, the flexible spacer material comprising a first portion for overlaying the sleeves and a second portion for overlaying the body, the second portion has three areas along its length, a lower-third area, central-third area and upper-third area, the spacing layer of crease-resistant flexible spacer material is locatable over the clothing article when the clothing article is laid in a stretched-out open condition;

the spacing layer of crease-resistant flexible spacer material forms a spacer separating parts of the clothing article which face each other when the clothing article is folded from the stretched-out condition to a folded state;

the spacing layer of crease-resistant flexible spacer material is shaped to overlay fold lines in the clothing article to prevent wrinkles and creases from forming along the fold lines;

on folding the sleeves and the first portion onto the central-third area of the second portion, the first portion separates the sleeves from the body of the article of clothing;

on folding the sleeves and the first portion onto the central-third area of the second portion, the first portion angulates the sleeves about the midpoint of the fold line in the first portion to enable the sleeve to fold at an angle onto the central-third areas of the second portion;

and the upper-third area and lower-third area are folded with the adjacent part of the body onto the central-third area.

In another embodiment of the present invention, the spacing layer is formed of a spacing layer of rigid or semi-rigid spacer material, wherein the spacer material has sufficient structural strength to maintain the clothing article in the folded condition when stored in an upright position, as well as to prevent the spacing layer from fracturing when bent when in storage and/or transit.

In another embodiment, the spacer material has three pre-formed edges, each has a continuous curve, U-shaped in cross-section, to overlay fold lines in the sleeves and the body of the clothing article.

In another embodiment, the spacer material is profiled by ways of tapering, long the preformed edges, thinning away from the edge, to increase gripping surface area to enhance engagement effectiveness between the spacer material and the clothing article and to reduce excess material to lower manufacturing costs.

In another embodiment, the spacer material has perpendicular ribs, comprising of longitudinal ribs and lateral ribs to form a grid like structure to maximize structural strength, on one or both sides of the spacer material, to form an anti-collapsible structure to prevent creases and wrinkles from forming in the folded clothing article, by maintaining the clothing article in its folded condition when the clothing article is stored in an upright position in storage and/or transit.

In another embodiment, the spacer material has gripping surface to engage the clothing article, to prevent the clothing article from slipping when the folded clothing article is stored in an upright position in storage and/or transit.

In another embodiment, the spacer material' is formed of foam, rubber, plastic, leather or a combination of these materials, to meet various marketing requirement.

In another embodiment, the spacer material has a minimum overall thickness of 10 mm along the preformed edges, so that excess material can be removed to reduce weight as well as manufacturing costs.

In another embodiment of the present invention, a method of packing's clothing article that has a body and sleeves, to simply, easily and quickly fold a clothing article, in which:

a spacing layer of rigid or semi-rigid spacer material is used, the spacer material comprising a single portion for overlaying the sleeves and the body, the spacer material is locatable over the clothing article when the clothing article is laid in a stretched-out open condition;

the spacer material forms a spacer separating parts of the clothing article which face each other when the clothing article is folded from the stretched-out condition to a folded state;

the spacer material is shaped to overlay fold lines in the clothing article to prevent wrinkles and creases from forming along the fold lines;

the sleeves, upper-body and lower-body of the clothing article are folded to rest on top of the spacer material.

BRIEF DESCRIPTION OF THE DRAWINGS

A preferred embodiment of the present invention will now be described, by way of example only, with reference to the accompanying drawings in which.

DETAILED DESCRIPTION OF THE PREFERRED EMBODIMENT

Figure 1:
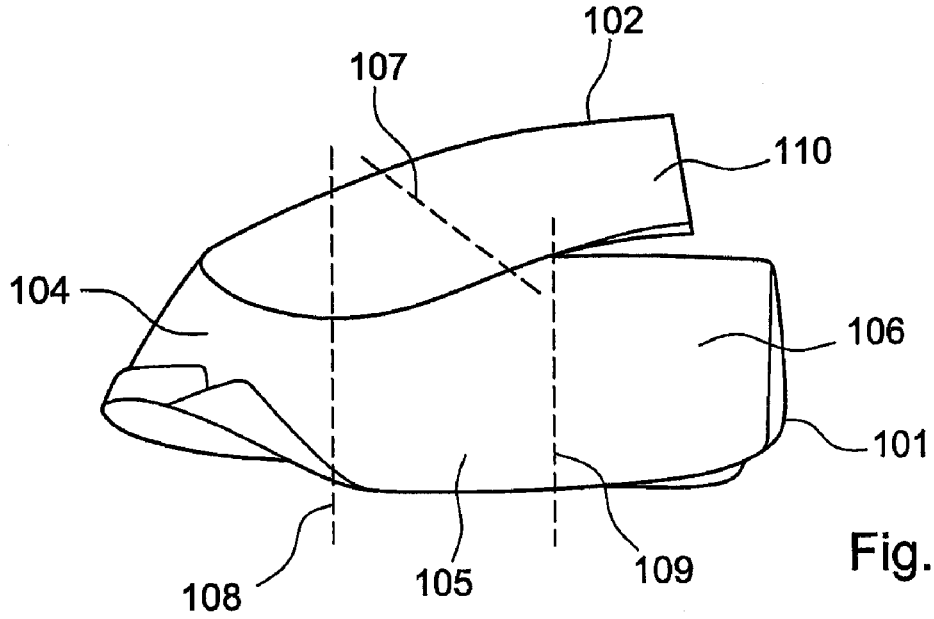
FIG. 1 illustrates the article of clothing to be packed with the present invention.

FIG. 1 shows a clothing article (101), a suit jacket, that has two aligned sleeves (102) and a body (103), laid in a stretched-out open condition, where the body is divided into three parts: upper-body (104), the central-body (105), and lower-body (106).

The clothing article (101) is folded backward to align the two sleeves and to lay the clothing article (101) in a stretched-out open condition to, i.) remove the wrinkles in the clothing article (101) before the clothing article (101) is folded;

ii.) create three individual fold lines in the clothing article (101): the sleeve fold line (107), the upper-body fold line (108), and the lower-body fold line (109);

iii.) simplify the folding process to three folding steps; and iv.) allow the clothing article (101) to fold to a compact size.

Figure 2A:
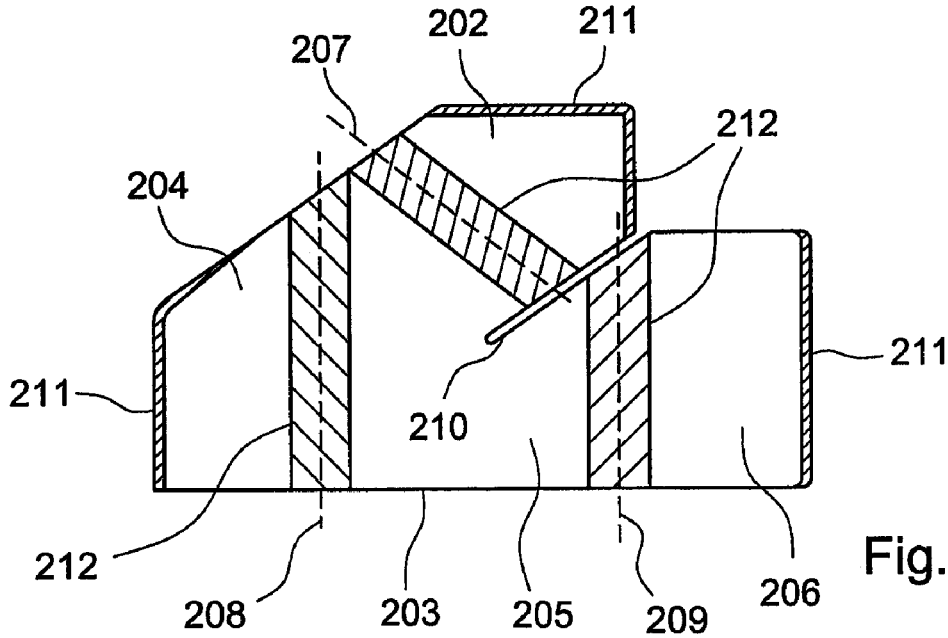
FIG. 2A to 2F illustrates an embodiment of the present invention.

FIG. 2A shows a preferred embodiment of the present invention of a clothing packing apparatus (201), a spacing layer of crease-resistant flexible spacer material, suitable for folding the clothing article (101) of any size, laid in the stretched-out open condition of FIG. 1.

Figure 2B:
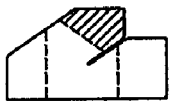
Figure 2C:
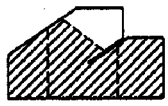
Figure 2D:
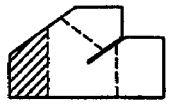
Figure 2E:
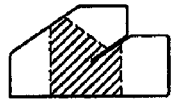
Figure 2F:
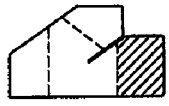

As shown in FIG. 2A, the spacing layer of crease-resistant flexible spacer material is comprised of, i.) a first portion (202), as highlighted in FIG. 2B, shaped to partially overlay two aligned sleeves (102) and a fold line (107) in the aligned sleeves (102) of the clothing article (101) laid in the stretched-out open condition, to allow the lower portion of the aligned sleeves (110) to be freely and discretely moved, adjusted and folded to rest at an angle on the central-third area (205);

ii.) a second portion (203), as highlighted in FIG. 2C, sectioned into three areas along its length: an upper-third area (204)—highlighted in FIG. 2D, a central-third-area (205)—highlighted in FIG. 2E, and a lower-third area (206)—highlighted in FIG. 2F, configured to partially overlay the upper-body (104), central-body (105), and lower-body (106) of the clothing article (101) respectively, as well as the upper-body fold line (108) and the lower-body fold line (109) of the clothing article (101) laid in the stretched-out open condition, to allow the adjacent parts of the clothing article, namely, the upper-body (104) and lower-body (106), to move and fold freely and discretely from their stretched-out open condition to the folded state, to rest on top of one another on the central-third area (205) on top of the folded lower-sleeves (110) of the clothing article (101);

iii.) three individual fold lines: the first fold line (207), the second fold line (208), and the third fold line (209), formed to partially overlay the sleeve fold line (107), upper-body fold line (108), and lower-body fold line (109) of the clothing article (101) respectively, to enable the first portion (202), upper-third area (204), and lower-third area (206) to respectively move with the aligned sleeves (102), upper-body (104), and lower-body (106) freely and discretely, to fold them on top of one another onto the central-third area (205);

iv.) a slit (210), extending from the third fold line (209) towards the centre of the central-third area (205), created to partially separate the first portion (202) and the second portion (203), to enable the first portion (202) to move freely and discretely with the aligned sleeves (102) as the lower-sleeves (110) is adjusted and folded to rest at an angle onto the central-third area (205);

v.) rounded or tapered edges (211), profiled to remove the abrupt steps in the flexible spacer material to prevent pressure impressions from forming in parts of the clothing article (101) overlapping the edges of flexible spacer material, preferably rounded to an elliptical cross-section profile, or tapered at an angle of less than 30° to the surface of the spacer material from the thickness of the spacer material to a thickness of 0.5 mm;

vi.) pre-formed markings (212), formed alongside the fold lines to accommodate overlaying the fold line in the clothing packing apparatus (201) over those in clothing articles (101) of different sizes, preferably moulded with a minimum width of 3 cm to centre along the first fold line (207), second fold line (208), and third fold line (209); and vii.) gripping surfaces, configured to engage the flexible spacer material and the clothing article (101) to maintain the folded pasts to the folded state, preferably produced by rubberizing both sides of the apparatus (201).

In addition, the preferred flexible spacer material is formed of foam that has a 3-ply construction, of which a woven fabric centre layer is sandwiched by two foam layers, to improve tearing strength to enhance-durability of the apparatus (201), formed to a minimum total thickness of 3 mm, to minimize material volume and weight while maintaining the effectiveness of the clothing packing apparatus (201), as well as providing the mean for adding attachments to the clothing packing apparatus (201), such as by stitching, to reliably integrate the apparatus (201) to different types of outer casing.

The preferred foam is an odorless closed-cell Thermoplastic Elastomer (TPE) foam that has rubberised gripping surfaces, Shore C Hardness range of 5-28, density range of 0.1-0.2 g/cm3, tensile strength greater than 2 kgf/cm2, tensile elongation greater than 150%, tear strength greater than 1 kgf/cm2, compression set greater than 95%, rebound greater than 60%, and shrinkages less than 10%.

Furthermore, rubber material and other types of foams are also suitable. Rubber material such as silicone rubber that has a Shore A hardness of about 2555 is particularly suitable.

Moreover, the preferred material of the outer casing is woven fabric but sheet material made of plastic, paper, metal, or a combination of the aforementioned is suitable for devising different types of outer casing to fit different modes of transportation and/or marketing purposes.

Figure 3A:
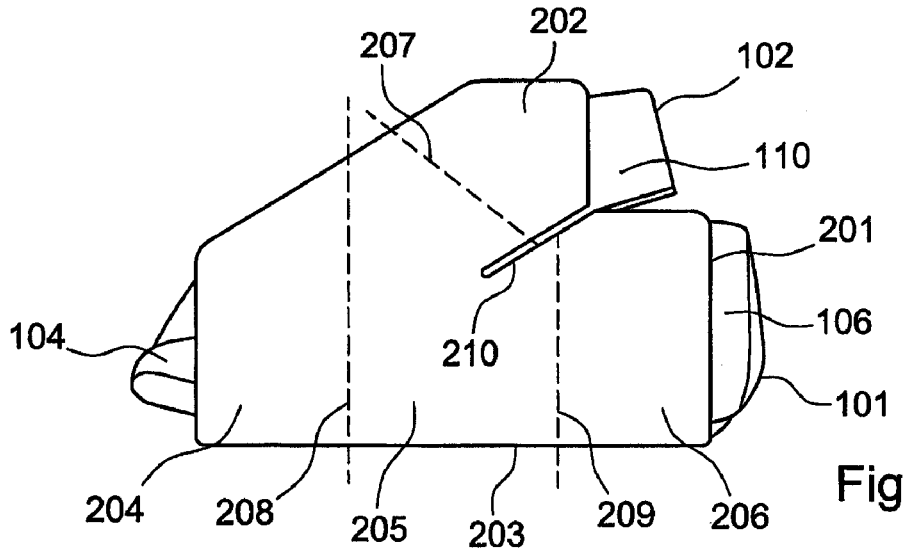
FIG. 3A to FIG. 3I illustrate the method of packing a sleeved clothing article around the embodiment of FIG. 2.

In use, as shown in FIG. 3A, the preferred embodiment of the clothing packing apparatus (201) is placed in an open condition on top of the clothing article (101) when the clothing article is laid in a stretched-out open condition, with the first portion (202) and second portion (203) partially overlaying the aligned sleeves (102) and the body (103) respectively, and the first fold line (207), second fold line (208), and third fold line (209) partially overlaying the sleeve fold line (107), upper-body fold line (108), and lower-body fold line (109) respectively.

Figure 3B:
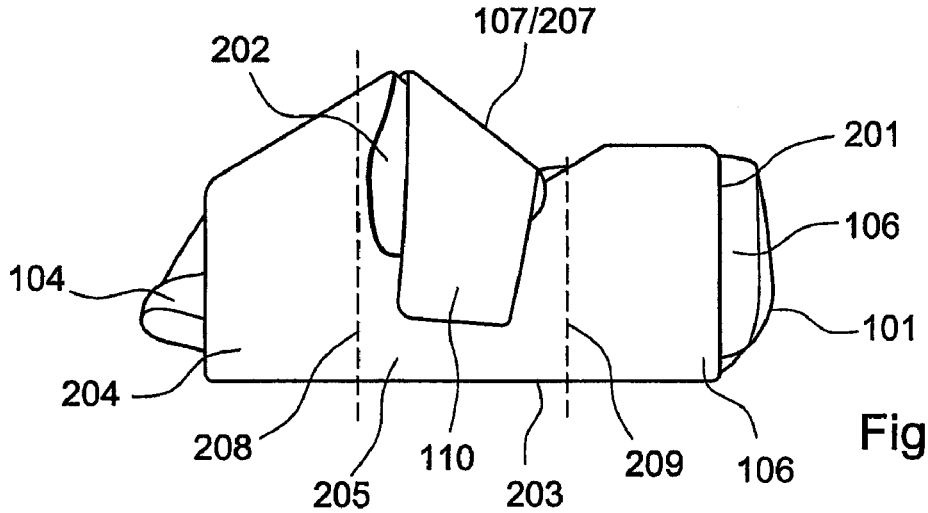

As shown in FIG. 3B, the aligned sleeves (102) are folded first of all onto the centre of the central-third area (205). The aligned sleeves (102) are freely and discretely moved with the first portion (202) to freely and discretely adjust and fold the lower-sleeves (110) around the first fold line (207), with the lower-sleeves (110) resting on the first portion (202) and against the first fold line (207).

Figure 3C:
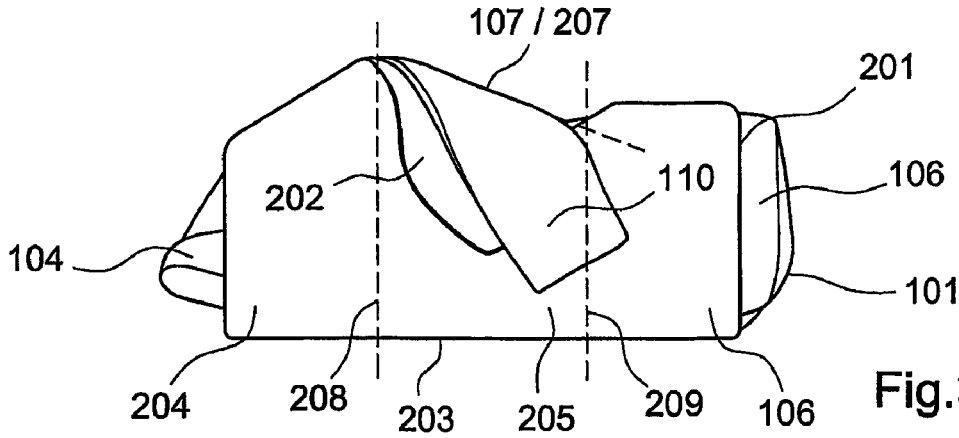

As shown in FIG. 3C, the first portion (202) and lower-sleeves (110) are angulated about the midpoint of the first fold line (207) to suitably adjust the angle of the first fold line (207) in order to move the first portion (202) and the lower-sleeves (110) onto the right-hand side of the central-third area (205) in a stretched-out state, to keep the lower-sleeves (110) away from the second fold line (208).

Figure 3D:
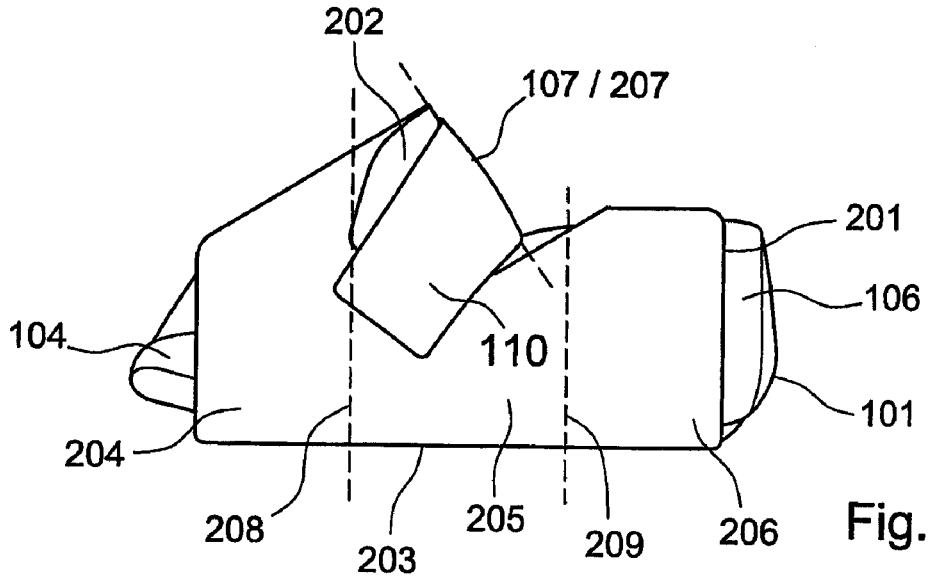

Conversely, as shown in FIG. 3D, the first portion 25 (202) and lower-sleeves (110) are angulated about midpoint of the first fold line (207) to suitably adjust the angle of the first fold line (207) in order to move the first portion (202) and the lower-sleeves (110) onto the left-hand side of the central-third area (205) in a stretched-out state, to keep the lower-sleeves (110) from the third fold line (209).

Figure 3E:
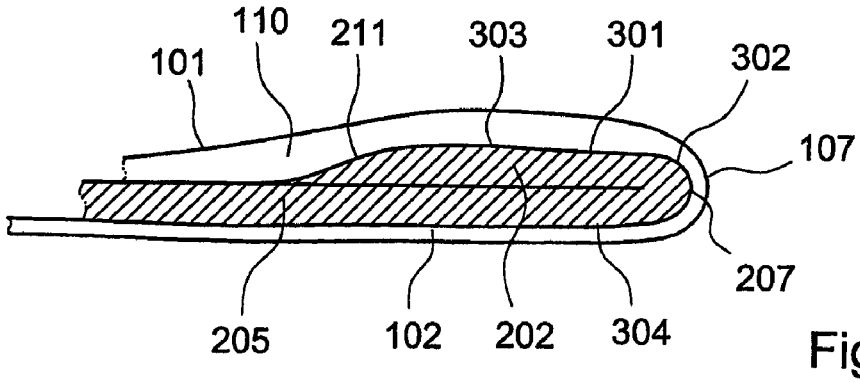

As shown in FIG. 3E, a first spacer (301—shaded) is formed to separate the aligned sleeve (102) and the lower-sleeves (110), comprising the first portion (202), the central-third area (205), a first continuous curve (302) that has a U-shaped cross section along the first fold line (207), and a first rounded or tapered edge (211).

As shown in FIG. 3E, the first spacer (301) is formed when the upper surface of the first portion (202) is folded with the lower-sleeve (110) to face downward to engage the upper surface of the central-third area (205), and the lower surface of the first portion (202) folded to face upward to form the spacer upper surface (303) with the lower surface of the central-third area (205) facing downward to form the spacer lower surface (304).

As shown in FIG. 3E, the first portion (202) resting on the upper surface of the central-third area (205) is engaged by the weight of the lower-sleeves (110) and the first portion (202), the upper surface of the lower-sleeves (102) resting on the first spacer upper surface (303) is engaged by the weight of the lower-sleeves (110), and the first spacer lower surface (304) resting on the unfolded part of the aligned sleeves (102) is engaged by the weight of the lower-sleeves (110), the first portion (202) and the central-third area (205).

The gripping upper and lower surfaces of the clothing packing apparatus (201) are preferably rubberised.

Figure 3F:
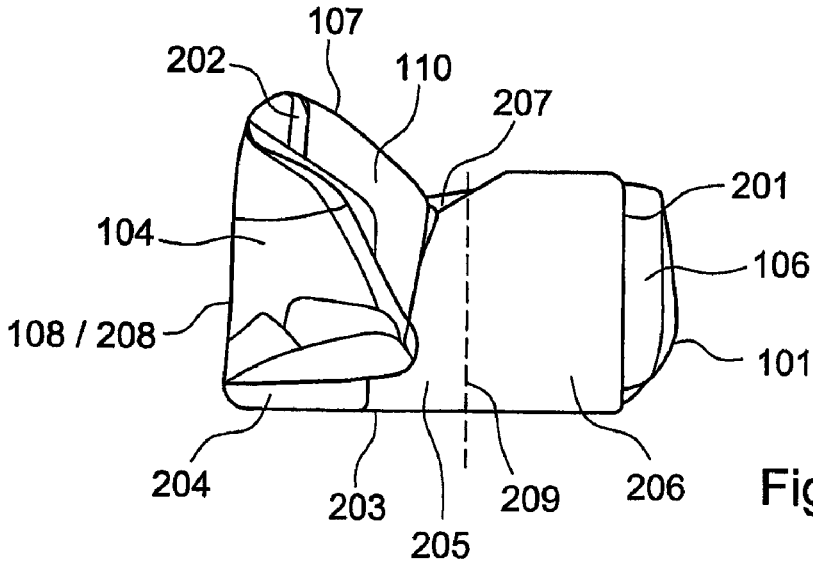

As shown in FIG. 3F, the upper-body (104) is freely and discretely moved with the upper-third area (204) to freely and discretely fold the upper-body (204) around the second fold line (208) onto the central-third area (205), to rest on top of the lower-sleeves (110).

Figure 3G:
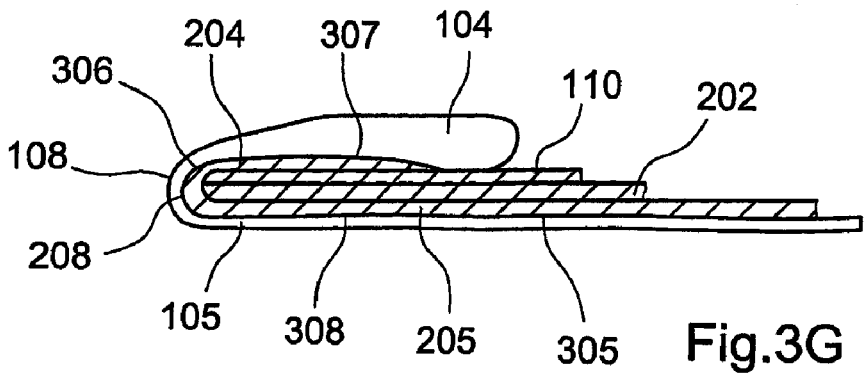

As shown in FIG. 3G, a second spacer. (305—shaded) is formed to separate the upper-body (104) and the central-body (105), comprising the upper-third area (204), the lower-sleeves (110), the first portion (202), the central-third area (205) to separate the upper-body (104) and the central-body (105), a second continuous curve (306) that has a U-shaped cross section along the second fold line (208), and a second rounded or tapered edge (211).

As shown in FIG. 3G, the second spacer (305) is formed when the upper surface of the upper-third area (204) is folded with the upper-body (104) to face downward to engage the upper surface of the lower-sleeves (110), and the lower surface of the upper-third area (204) folded to face upward to form the second spacer upper surface (307) with the lower surface of the central-third area (205) facing downward to form the second spacer lower surface (308).

As shown in FIG. 3G, the upper-third area (204) resting on the upper surface of the lower-sleeves (110) is engaged by the weight of the upper-body (104) and the upper-third area (204), the upper surface of the upper-body (104) resting on the second spacer upper surface (307) is engage by the weight of the upper-body (104), and the second spacer lower surface (308) resting on the central-body (105) is engaged by the weight of the upper-body (104), the upper-third area (204), the lower-sleeves (110), the first portion (202) and the central-third area (205).

As shown in FIG. 3G, the engagement of the lower-sleeves (110) and the first spacer (301) is strengthen by the additional weight provided by the upper-body (104) and upper-third area (204).

Figure 3H:
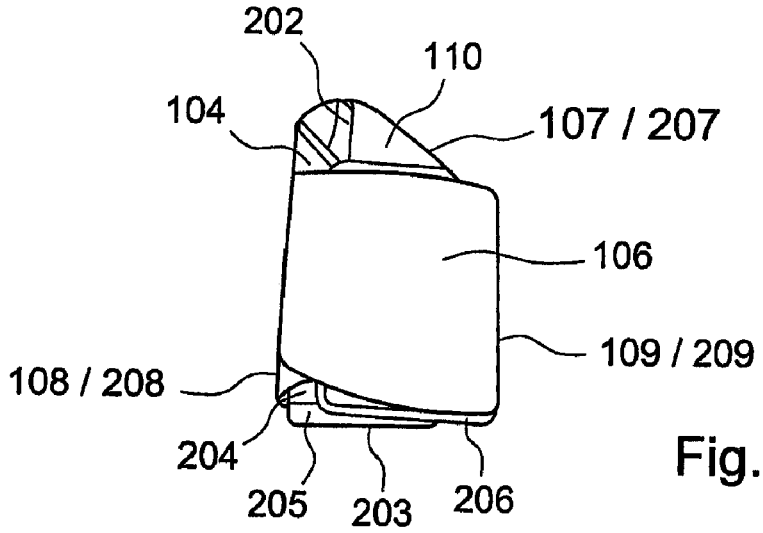

As shown in FIG. 3H, the lower-body (106) is freely and discretely moved with the lower-third area (206) to freely and discretely fold the lower-body (206) around the third fold line (209) onto the central-third area (205), to rest on top of the upper-body (104).

Figure 3I:
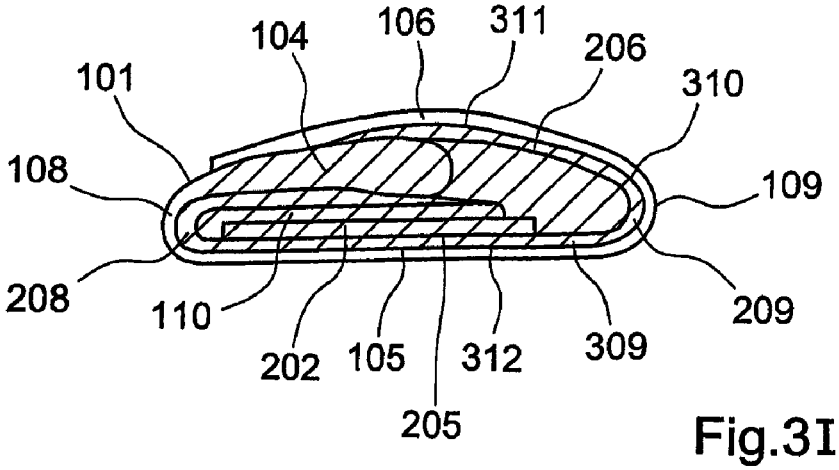

As shown in FIG. 3I, a third spacer (309—shaded) is formed to separate the lower-body (106) and the central-body (105), comprising the lower-third area (206), the 15 upper-body (104), the upper-third area (204), the lower-sleeves (110), the first portion (202), the central-third area (205), the central-body (105), a third continuous curve (310) that has a U-shaped cross section along the third fold line (209), and a third rounded or tapered edge (211).

As shown in FIG. 3I, the third spacer (308) is formed when the upper surface of the lower-third area (206) folded with the lower-body (106) to face downward to engage the upper surface of the lower-sleeves (110), and the lower surface of the lower-third area (206) folded to face upward to form the third spacer upper surface (311) with the lower surface of central-third area (205) facing downward to form the third spacer lower surface (312).

As shown in FIG. 3I, the lower-third area (206) resting on the upper surface of the upper-body (104) is engaged by the weight of the lower-body (106) and the lower-third area (206), the upper surface of the lower-body (106) resting on the third spacer upper surface (311) is engaged by the weight of the lower-body (106), and the third spacer lower surface (312) resting on the central-body (105) is engaged by the weight of the lower-body (106), the lower-third area (206), the upper-body (104), the upper-third area (204), the lower-sleeves (110), the first portion (202) and the central-third area (205).

As shown in FIG. 3I, the engagement of the aligned sleeves (102) and the first spacer (301), and that between the upper-body (104) and the second spacer (308), are strengthened by the additional weight provided by the lower-body (106) and lower-third area (206).

The clothing packing article (201) is transformed into a three-dimensional anti-collapsible structure supported and reinforced by the clothing article (101) and the outer casing when the article clothing installed in an outer casing.

A pair of trousers (401) of the clothing article (101), laid in an aligned and stretched-out open condition, is now folded using the clothing article (101) folded around the clothing packing apparatus (201), comprising two parallel continuous curves that has U-shaped cross section along the upper-body fold line (108) and the lower-body fold line (109).

Figure 4A:
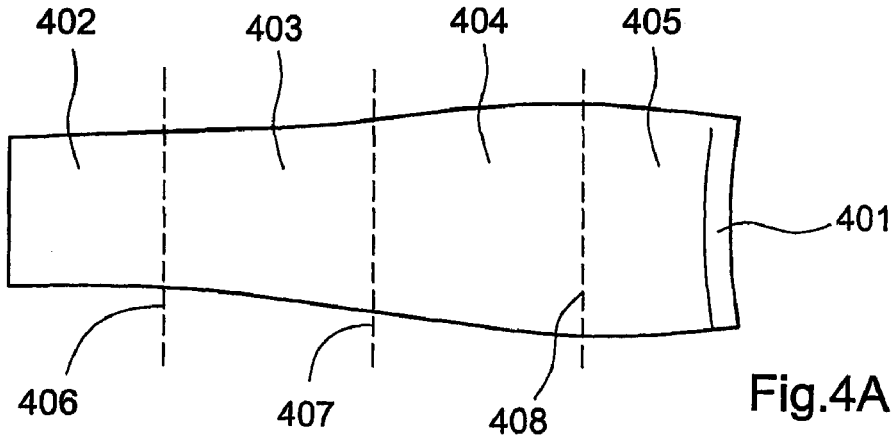
FIG. 4A to 4F illustrates the method of packing a pair of trousers around the sleeved clothing article folded around the embodiment of FIG. 2.

As shown in FIG. 4A, a pair of trousers (401) laid in a stretched-out open condition is sectioned into four parts: the lower leg (402); the lower-middle leg (403), the upper-middle leg (404); and the upper leg (405), separated by three fold lines: the lower-leg fold line (406), middle-leg fold line (407), and upper-leg fold line (408).

Figure 4B:
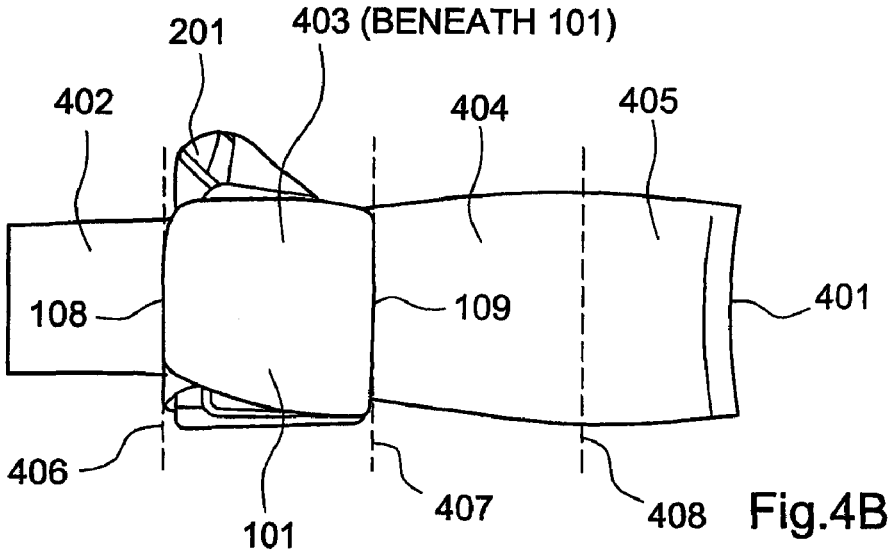

As shown in FIG. 4B, the clothing article (101) folded around the clothing packing apparatus (201) is placed on the lower-middle leg (403) with the upper-body fold line (108) aligned to the lower-leg fold line (406) and the lower-body fold line (109) aligned to the middle-leg fold line (407).

Figure 4C:
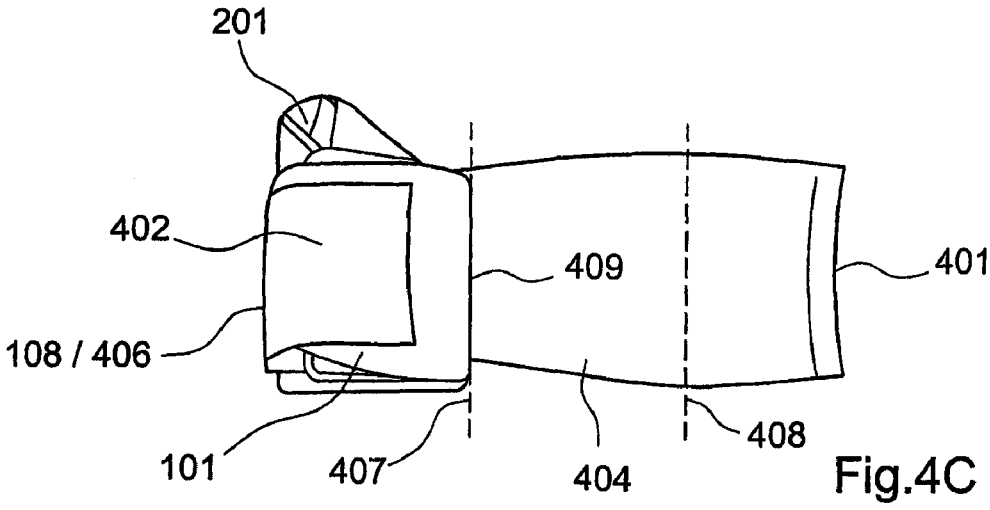

As shown in FIG. 4C, the lower-leg (402) is freely and discretely moved and folded around the upper-body fold line (108) on top of the clothing article (101) folded around the clothing packing apparatus (201).

Figure 4D:
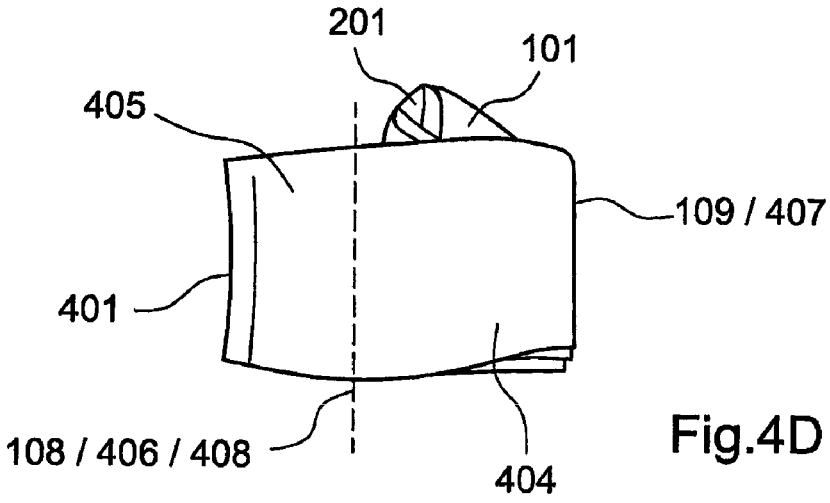

As shown in FIG. 4D, the upper-middle leg (404) and: upper leg (405) are freely and discretely moved together to fold around the lower-body fold line (109) to rest the upper-middle leg (404) on top the clothing article (101) folded around the clothing packing apparatus (201).

Figure 4E:
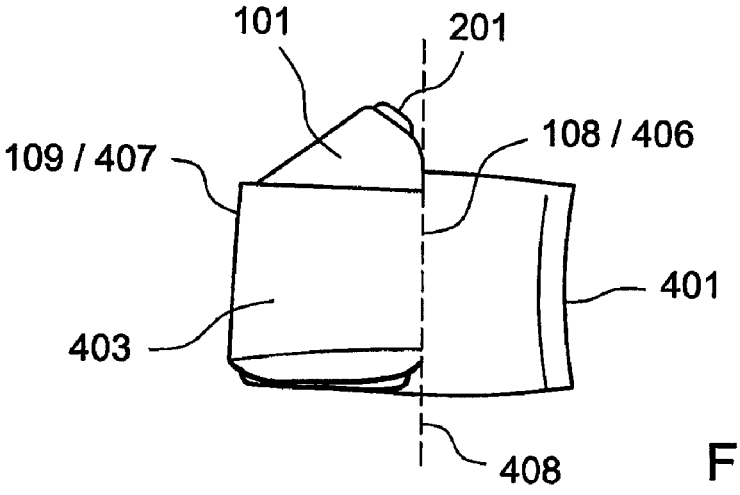

As shown in FIG. 4E, the clothing article (101) folded around the clothing packing apparatus (201) and the partially folded pair of trousers (401) is then turned upside down.

Figure 4F:
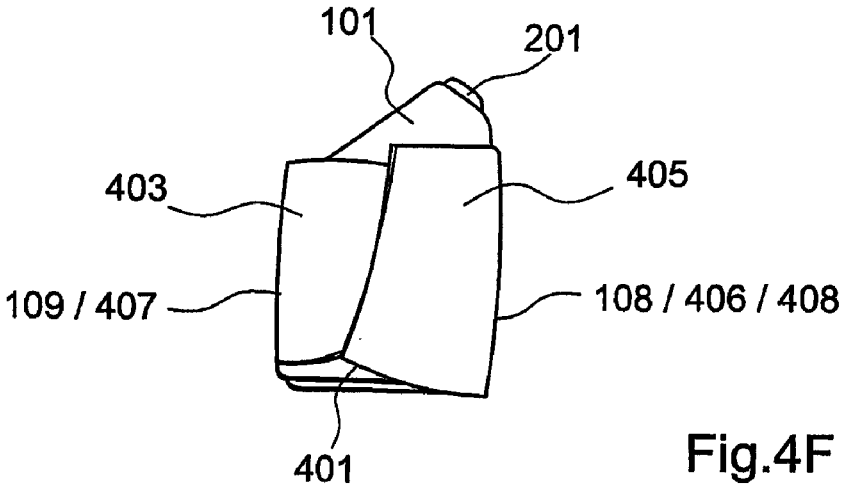

As shown in FIG. 4F, the upper leg (405) is freely and discretely moved and folded around the upper-body fold line (108) to complete the folding process.

Figure 5:
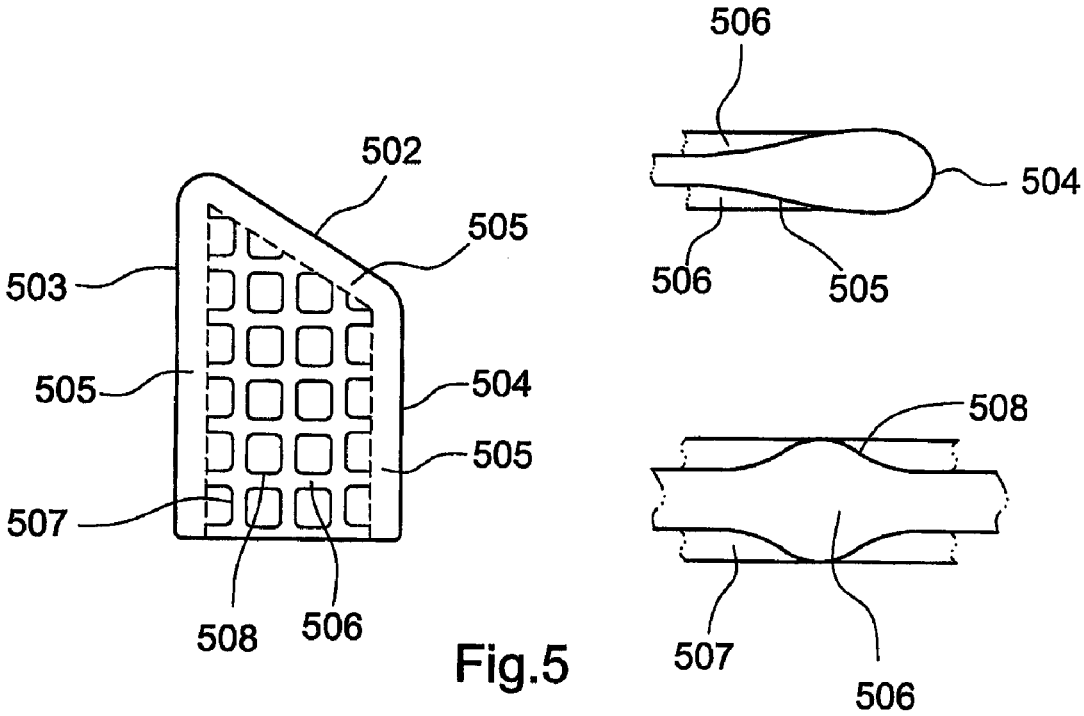
FIG. 5 illustrates another embodiment of the present invention.

FIG. 5 shows another embodiment of the present invention of a clothing packing apparatus, comprising a spacing layer of rigid or semi-rigid spacer material (501), for folding the clothing article (101) of any size, laid in a stretched-out open condition of FIG. 1, wherein the spacing material is comprised of, i.) three preformed edges, U-shaped in cross-section, with a minimum radius of 5 mm: a first-edge (502) for overlaying the sleeve fold line (107); a second-edge (503) for overlaying the upper-body fold line (108); and a third-edge (504) for overlaying the lower-body fold line (109);

ii.) taperings (505), thinning away from the preformed edges, to reduce excess material to reduce weight, manufacturing costs and enhance gripping effect;

iii.) perpendicular ribs, comprising lateral ribs (506) and longitudinal ribs (507), to provide an anti-collapsible structure, wherein the ribs have a minimum cross-section diameter of 10 mm, in addition to circular and tapering profiles (508), to reduce or eliminate pressure impressions from forming in the clothing article when the clothing article is stored under heavy loads or compressed; and iv.). gripping surfaces, to engage the clothing article to prevent the clothing article from slipping and collapsing to prevent creases and wrinkles from forming in the clothing article.

The preferred spacing layer of rigid or semi-rigid spacer material is formed of closed cell foam such as Low Density Polyethylene (LDPE) with a specific density: approximately 920 kg/m$^3$, modulus of elasticity: between 240 30 MPa and 340 MPa, and Hardness Shore D: between 44 and 48.

Figure 6A:
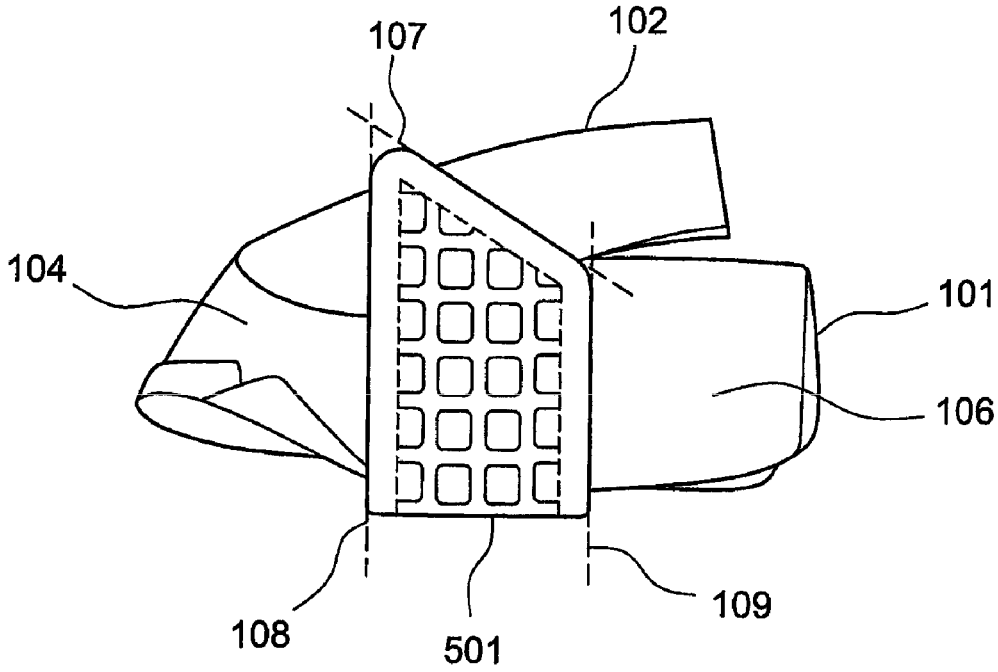
FIGS. 6A to 6G illustrate the method of packing a sleeved clothing article around the embodiment of FIG. 10.

As shown in FIG. 6A, the spacing layer of rigid or semi-rigid spacer material is located partially over the central-body (105) and the upper portion of the two aligned sleeves (102), with the first-edge overlaying the sleeves fold line (107), the second-edge (503) overlaying the upper-body fold line (108), and the third-edge (504) overlaying the lower-body fold line (109), of a sleeved clothing article (101) in a stretched-out open condition, as the first step to fold the clothing article from a stretched-out open condition to the folded state.

Figure 6B:
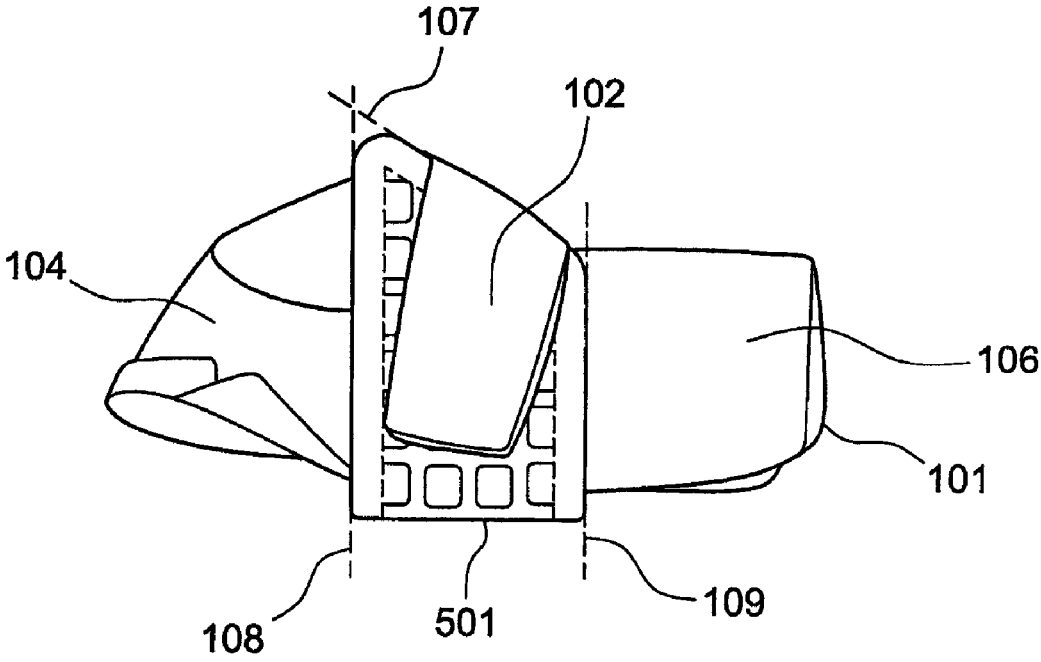

As shown in FIG. 6B, the two aligned sleeves (102) are folded along the sleeve fold line (107) and around the first-edge (502), to discretely place the sleeves (102) on top of the spacing material (501), without disturbing the body of the clothing, article to prevent creases and wrinkles from forming in the clothing article.

Figure 6C:
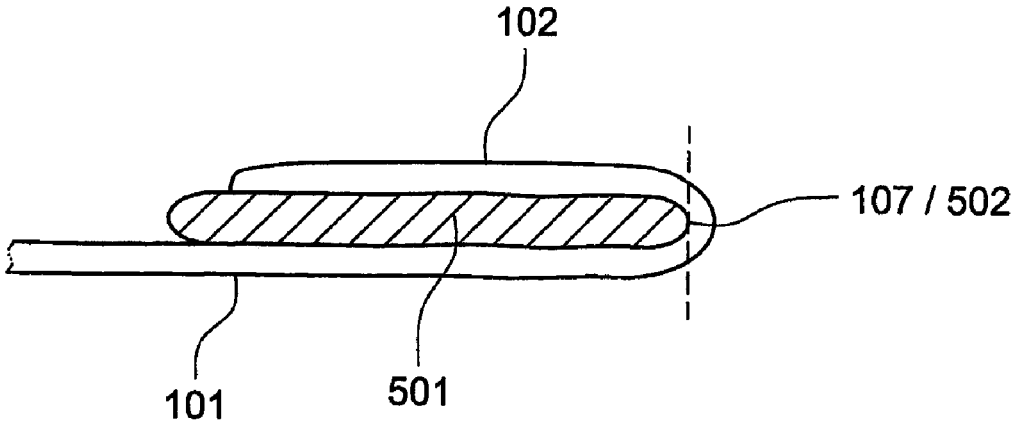

As shown in FIG. 6C, the sleeves (102) are tucked firmly against the first-edge (502) to eliminate creases and wrinkles from forming along the sleeve fold line (107) and stop it from dislocating from its folded position, with the spacing layer of rigid or semi-rigid spacer material (501) forming a spacer separating the folded sleeves (102) folded to face the central-body (105) of the clothing article (101).

Figure 6D:
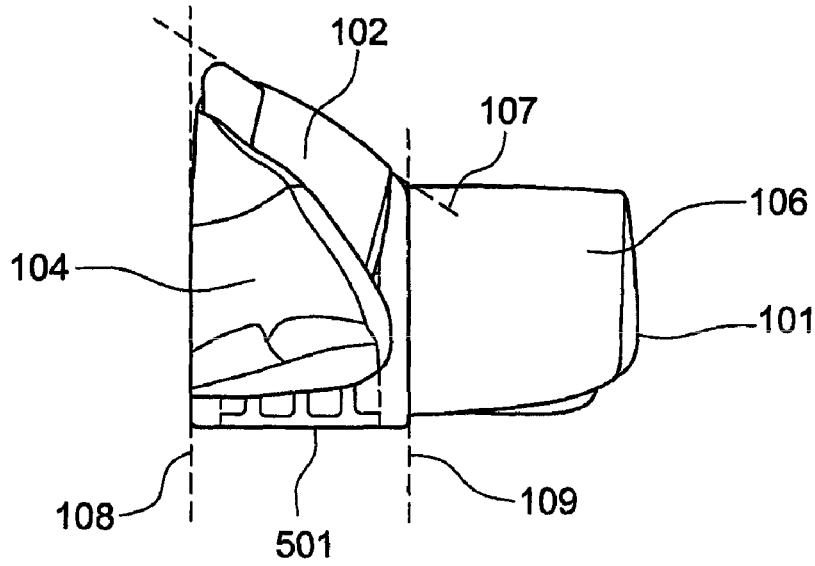

As shown in FIG. 6D, the upper-body (104) of the clothing article (101) is then folded discretely along the upper-body fold line (108), to rest on top of the folded portion of the sleeves (102), without disturbing the folded portion of the sleeves (102) and the lower-body (106) of the clothing article (101), to prevent creases and wrinkles from forming in the clothing article.

Figure 6E:
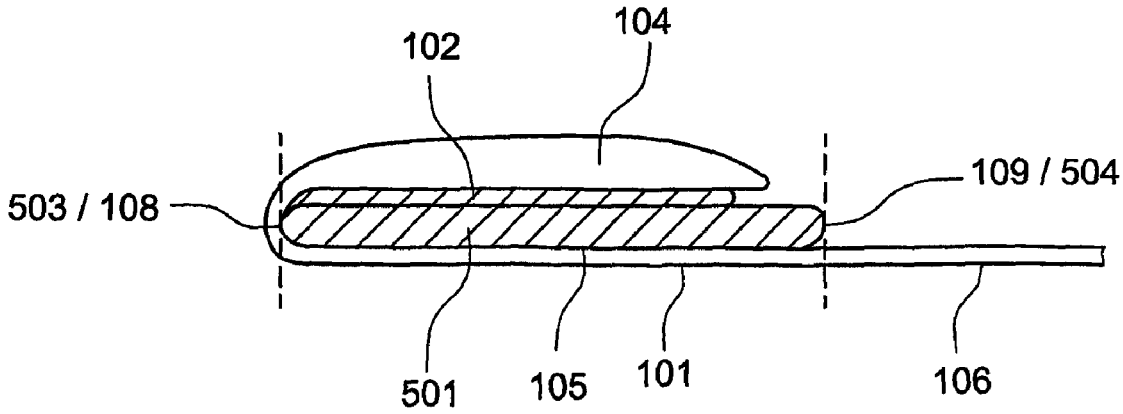

As shown in FIG. 6E, the upper-body (104) is tucked firmly against the second-edge (503) to prevent creases and wrinkles from forming along the upper-body fold line (108) and stop it from dislocating from the folded position, with the spacing layer of rigid or semi-rigid spacer material (501) and the folded sleeves (102) forming a spacer separating the upper-body (104) folded to face the central-body (105) of clothing article (101).

Figure 6F:
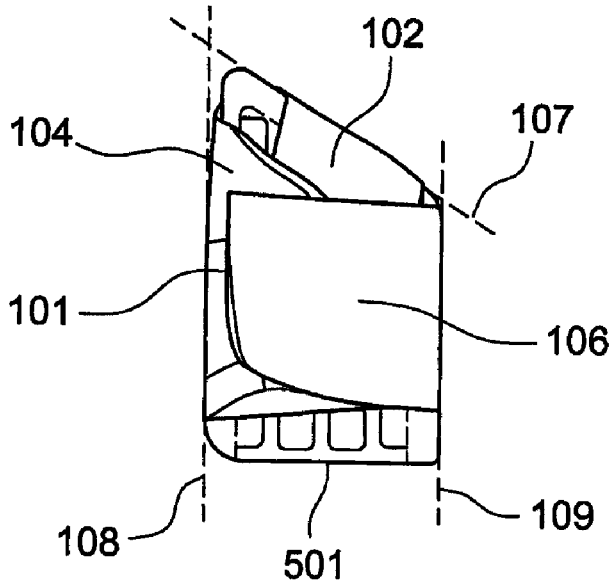

As shown in FIG. 6F, the lower-body (106) of the clothing article (101) is the folded discretely along the lower-body fold line (109) to rest on top of the folded upper-body (104).

Figure 6G:
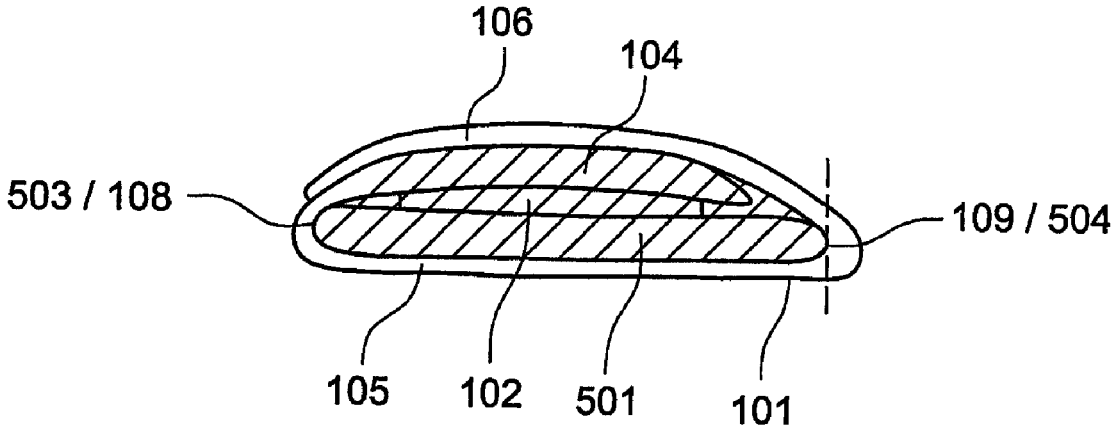

As shown in FIG. 6G, the lower body is tucked firmly against the third-edge (504) of the spacing layer of rigid or semi-rigid spacer material (501) to prevent creases and wrinkles from forming along the lower-body fold line (108) and stop it from dislocating from its folded position, with the spacing layer of rigid or semi-rigid spacer material (501), folded portion of the sleeves (102) and the folded upper-body (104) forming a spacer separating the lower-body (106) folded to face the central-body (105) of the clothing article (101).

The folded sleeves (102), upper-body (104), lower-body (106) and the spacer material (501) are engaged, by friction, by the gripping surfaces of material the clothing article (101) and the spacer material (501), under the weight of the folded portion of the clothing article (101). The underside of lower-body (106) is engaged by the upper surface of the folded upper-body (104), while the underside of the upper-body (104) is engaged by the upper surface of the folded sleeves (102), and the lower surface of the folded sleeves (102) is engaged by the upper surface of the spacer material (501).

The trousers are then folded from the stretched-out open condition to a folded state as illustrated in the preceding, as in FIG. 4A to 4F to complete the folding process.

The folded clothing article is then packed into an outer casing to make it easier and more comfortable to carry. A number of configurations of the out casing are provided.

Figure 7A:
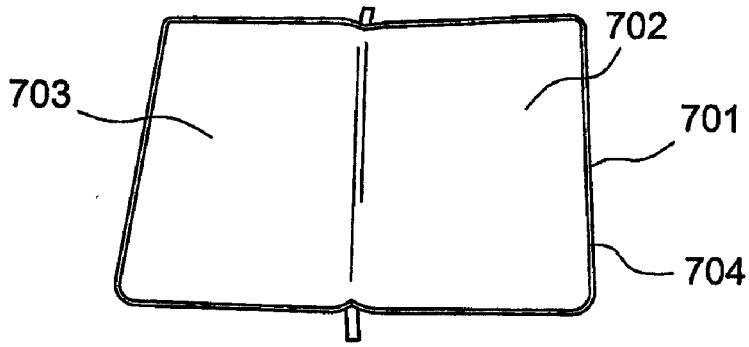
FIGS. 7A to 7C illustrate how the embodiment of FIG. 2 is incorporated to an outer casing in the form of a luggage case.

As Shown in FIG. 7A, a simple outer casing (701) that has two covers: a first cover (702) and a second cover (703) and a single continuous zipper closure (704) around three sides of the casing is laid in an open condition to receive the clothing article (101) and the pair of trousers (401) folded around the clothing packing apparatus (201).

Figure 7B:
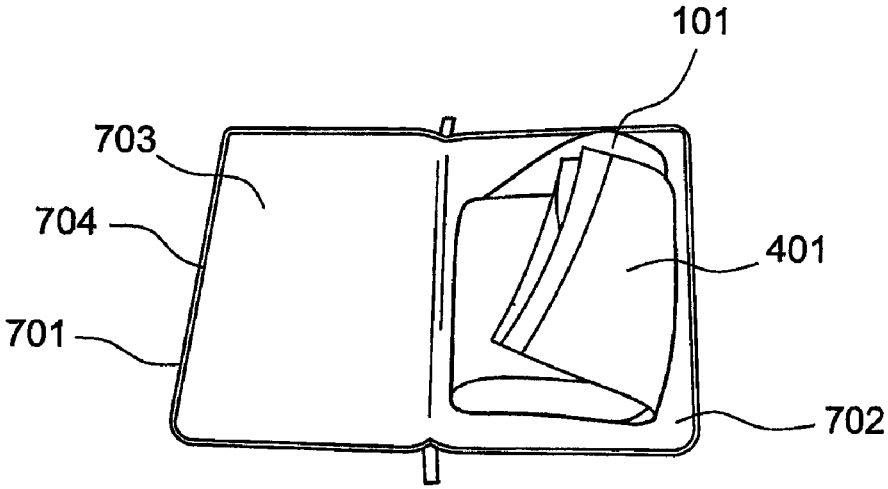

As shown in FIG. 7B, the clothing article (101) and the pair of trousers (401) folded around the clothing packing apparatus (201) is placed on the first cover (502).

Figure 7C:
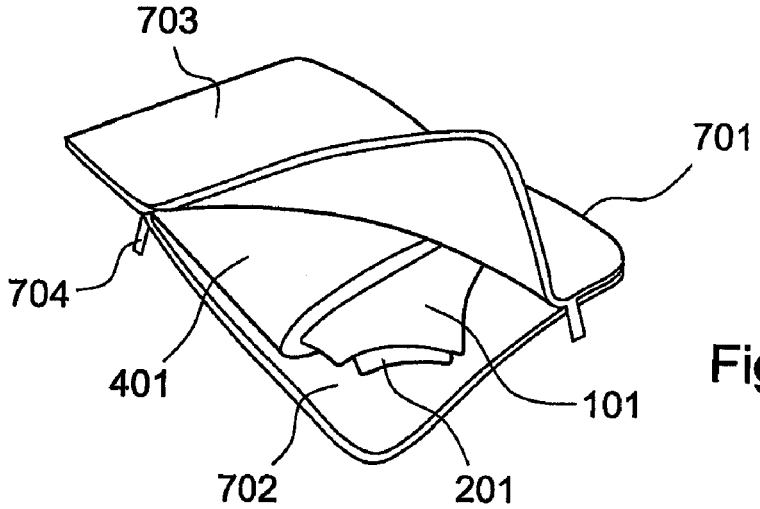

As shown in FIG. 7C, the clothing article (101) and the pair of trousers (401) folded around the clothing packing apparatus (201) is zip closed to install the clothing article (101) and the pair of trousers (401) inside outer casing (701) in the form of a softside luggage case.

Figure 8:
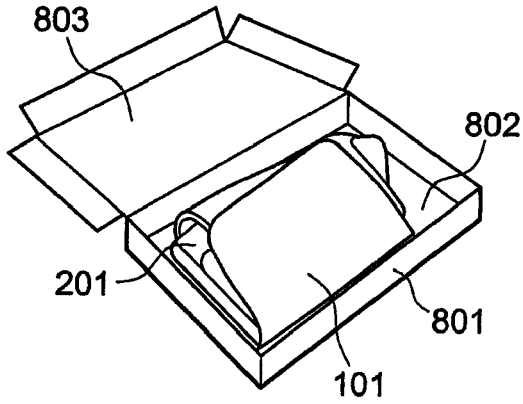
FIG. 8 illustrates how the embodiment of FIG. 2 is incorporated to an outer casing in the form of a courier box.

Alternatively, as shown in FIG. 8, the clothing article (101) and the pair of trousers (401) folded around the clothing packing apparatus (201) is install inside outer casing (801) comprising a container (802) and a cover (803), in the form of a paper courier box.

Figure 9:
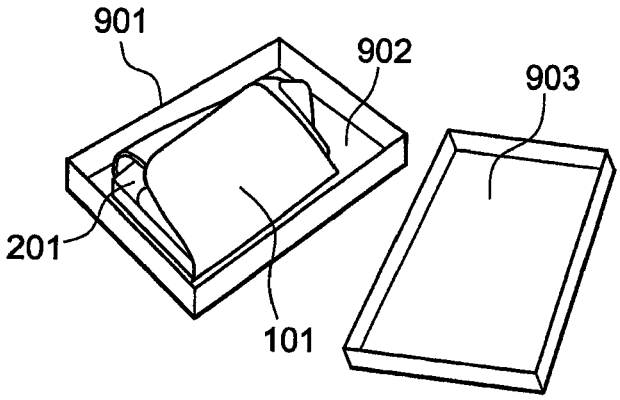
FIG. 9 illustrates how the embodiment of FIG. 2 is incorporated to an outer casing in the form of a gift box.

Alternatively, as shown in FIG. 9, the clothing article (101) and the pair of trousers (401) folded around the clothing packing apparatus (201) is install inside outer casing (901), comprising a container (902) and a 10 cover (903), in the form of a paper, plastic, or metal gift box.

Figure 10:
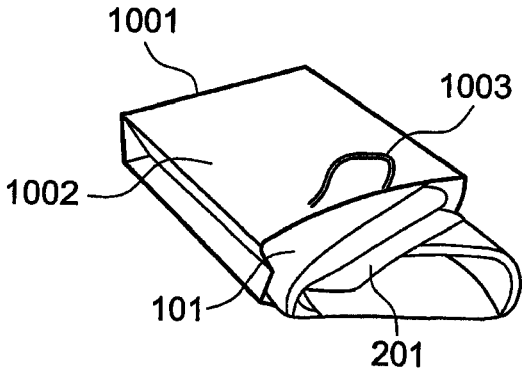
FIG. 10 illustrates how the embodiment of FIG. 2 is incorporated to an outer casing in the form of a shopping bag.

Alternatively, as shown in FIG. 10, the clothing article (101) and the pair of trousers (401) folded around the clothing packing apparatus (201) is install inside outer casing (801), comprising a container (1002) and handles (1002), in the form of a paper or plastic shopping bag.

Figure 11:
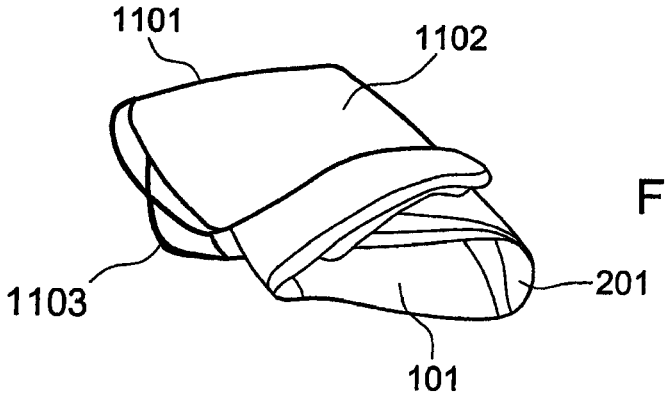
FIG. 11 illustrates how the embodiment of FIG. 2 is incorporated to an outer casing in the form of a promotional bag.

Alternatively, as shown in FIG. 11, the clothing article (101) and the pair of trousers (401) folded around the clothing packing apparatus (201) is install inside outer casing (1101), comprising a container (1101) and the drawstring closure (1103), in the form of a promotional drawstring fabric or plastic bag.

The invention claimed is:

1. A clothing packing apparatus for folding an article of clothing, the apparatus comprising:

a first portion, and a second portion with a longitudinal axis, wherein said second portion has a lower-third area, a central-third area and an upper-third area, wherein said first portion is foldable relative to said second portion about a first fold line, wherein said upper-third area is foldable relative to said central-third area about a second fold line, wherein said lower-third area is foldable relative to said central-third area about a third fold line, wherein said first fold line is at an angle relative to said longitudinal axis, a slit having an open first end located adjacent said third fold line, the slit extending therefrom into the central-third area, directed towards a centre of said central-third area, the slit having a second end located within the central-third area, the slit partially separating the first portion from the second portion, and, wherein said first fold line terminates between the ends of the slit.

2. An apparatus according to claim 1 wherein said slit is at an angle to the longitudinal axis of said second portion.

3. An apparatus according to claim 1 wherein said apparatus has a rubberized surface.

4. An apparatus according to claim 1 wherein said apparatus is made from a material selected from the group consisting of is foam, rubber, plastic, leather, textile or a combination thereof.

5. An apparatus according to claim 1 wherein edges of said apparatus are at least partially rounded or tapered.

6. An apparatus according to claim 3 wherein said edges taper downwardly in thickness towards said edges at an angle of less than 30° relative to surfaces adjacent thereto.

7. An apparatus according to claim 1 wherein surfaces located adjacent said fold lines have pre-formed markings.

8. An apparatus according to claim 7 wherein said markings are centered along said fold lines.

9. An apparatus according to claim 1 further including ribs on either or both sides of said apparatus.

10. An apparatus according to claim 9 wherein said ribs have a cross-section diameter of at least 10 mm.

11. An apparatus according to claim 9 wherein said ribs have a circular and/or tapering profile.

12. A method of packing a clothing article with a body and two sleeves comprising the steps of:

(a) providing a clothing packing apparatus having a first portion, and a second portion with a longitudinal axis, said second portion having a lower-third area, a central-third area and an upper-third area, said first portion being foldable relative to said second portion about a first fold line, said upper-third area being foldable relative to said central-third area about a second fold line, said lower-third area being foldable relative to said central-third area about a third fold line, said first fold line is at least partially within the width of the central-third area;

(b) folding said clothing article into a condition in which the two sleeves overlay each other and are thus aligned with each other;

(c) laying said clothing packing apparatus on said folded clothing article such that said first and second portions partially overlay said sleeves, said first fold line overlays said sleeves, and said second portion overlays said body;

(d) folding said sleeves and said first portion about said first fold line onto said central-third area of said second portion;

(e) folding said upper-third area of said second portion with the part of clothing article overlaid thereby about said second fold line onto said central-third area of said second portion; and (f) folding said lower-third area of said second portion with the part of clothing article overlaid thereby about said third fold line onto said central-third area of said second portion.

13. A method according to claim 12 further including steps of:

(g) providing an outer casing; and (h) placing said article of clothing folded after said step (f) into said outer casing.

* * * * *